US008382019B2

(12) United States Patent
Romanovich et al.

(10) Patent No.: US 8,382,019 B2
(45) Date of Patent: Feb. 26, 2013

(54) IN-RUSH CURRENT JAM PROOF SENSOR CONTROL

(75) Inventors: Dmitry Romanovich, Wheaton, IL (US); Michael Dale Jensen, Wood Dale, IL (US)

(73) Assignee: Fellowes, Inc., Itasca, IL (US)

( * ) Notice: Subject to any disclaimer, the term of this patent is extended or adjusted under 35 U.S.C. 154(b) by 316 days.

(21) Appl. No.: 12/772,722

(22) Filed: May 3, 2010

(65) Prior Publication Data

US 2011/0266379 A1 Nov. 3, 2011

(51) Int. Cl.
*B02C 4/32* (2006.01)
*B02C 7/14* (2006.01)
*B02C 9/04* (2006.01)

(52) U.S. Cl. ..... 241/36; 241/100; 241/236

(58) Field of Classification Search ..... 241/33, 241/35, 36, 100, 236, 27, 30
See application file for complete search history.

(56) References Cited

U.S. PATENT DOCUMENTS

| | | | |
|---|---|---|---|
| 2,221,516 | A | 4/1937 | Hathaway |
| 3,619,537 | A | 11/1971 | Hosokawa et al. |
| 3,724,766 | A | 4/1973 | Bosland |
| 3,764,819 | A | 10/1973 | Muller |
| 3,785,230 | A | 1/1974 | Lokey |
| 3,829,850 | A | 8/1974 | Guetersloh |
| 3,947,734 | A | 3/1976 | Fyler |
| 4,192,467 | A | 3/1980 | Hatanaka |
| 4,352,980 | A | 10/1982 | Hibari |
| 4,378,717 | A | 4/1983 | Schneider et al. |
| 4,489,897 | A | 12/1984 | Turner |
| 4,495,456 | A | 1/1985 | Vercillo et al. |
| 4,497,478 | A | 2/1985 | Reschenhofer |
| 4,683,381 | A | 7/1987 | Dufoug |

(Continued)

FOREIGN PATENT DOCUMENTS

| | | |
|---|---|---|
| DE | 3313232 | 10/1984 |
| DE | 8619856.4 | 10/1988 |

(Continued)

OTHER PUBLICATIONS

Complaint for Declaratory Judgment filed on Nov. 15, 2010 by *Royal Applicance Manufacturing Co., d/b/a/ TTI Floor Care North America and Techtronic Industries Co. Ltd.* against *Fellowes, Inc.*

(Continued)

*Primary Examiner* — Bena Miller
(74) *Attorney, Agent, or Firm* — Pillsbury Winthrop Shaw Pittman LLP

(57) ABSTRACT

A shredder and a method for monitoring a motor of a shredder comprises a housing having a throat for receiving an article and a shredder mechanism received in the housing for shredding the article, the mechanism including an electrically powered motor and cutter elements, and the motor being operable to drive the cutter elements in a shredding direction to shred articles. A current sensor for detecting current flowing through the motor and a controller coupled to the motor for controlling operation of the motor are also provided. The controller is also coupled to the current sensor and configured to detect at least an initial amount of current (or inrush current) supplied to the motor for each shredding event. Based on the inrush current, the controller sets a parameter (e.g., overload or thickness) to prevent overloading or stalling of the motor, such as caused by a jam or overheating.

22 Claims, 11 Drawing Sheets

U.S. PATENT DOCUMENTS

| | | | | |
|---|---|---|---|---|
| 4,707,704 | A | | 11/1987 | Allen |
| 4,757,949 | A | | 7/1988 | Horton |
| 4,814,632 | A | | 3/1989 | Glaeser |
| 4,815,669 | A | | 3/1989 | Fujii |
| 4,842,205 | A | | 6/1989 | Araki |
| 4,889,291 | A | | 12/1989 | Goldhammer et al. |
| 4,890,797 | A | | 1/1990 | Fujii et al. |
| 4,914,721 | A | | 4/1990 | Glaeser |
| 5,017,972 | A | | 5/1991 | Daughton |
| 5,081,406 | A | | 1/1992 | Hughes et al. |
| 5,139,205 | A | | 8/1992 | Gallagher et al. |
| 5,166,679 | A | | 11/1992 | Vranish et al. |
| 5,167,374 | A | | 12/1992 | Strohmeyer |
| 5,186,398 | A | | 2/1993 | Vigneau, Jr. |
| 5,198,777 | A | | 3/1993 | Masuda et al. |
| 5,342,033 | A | | 8/1994 | Iwata |
| 5,345,138 | A | | 9/1994 | Mukaidono et al. |
| 5,353,468 | A | | 10/1994 | Yap |
| 5,397,890 | A | | 3/1995 | Schueler et al. |
| 5,409,171 | A | | 4/1995 | Stangenberg et al. |
| 5,415,355 | A | | 5/1995 | Gollwitzer |
| 5,429,313 | A | | 7/1995 | Schwelling |
| 5,453,644 | A | | 9/1995 | Yap |
| 5,494,229 | A | | 2/1996 | Rokos |
| 5,539,322 | A | | 7/1996 | Zoughi et al. |
| 5,662,280 | A | | 9/1997 | Nishio et al. |
| 5,743,521 | A | | 4/1998 | Munakata et al. |
| 5,772,129 | A | | 6/1998 | Nishio et al. |
| 5,775,605 | A | | 7/1998 | Tsai |
| 5,823,529 | A | | 10/1998 | Mandel |
| 5,850,342 | A | | 12/1998 | Nakamura et al. |
| 5,850,588 | A | * | 12/1998 | Yoshikawa ..... 399/327 |
| 5,871,162 | A | | 2/1999 | Rajewski |
| 5,924,637 | A | | 7/1999 | Niederholtmeyer |
| D412,716 | S | | 8/1999 | Kroger |
| 5,942,975 | A | | 8/1999 | Sorenson |
| D414,198 | S | | 9/1999 | Iwata |
| 5,988,542 | A | | 11/1999 | Henreckson |
| 6,065,696 | A | | 5/2000 | Tsai |
| D426,805 | S | | 6/2000 | Iwata |
| 6,079,645 | A | | 6/2000 | Henreckson et al. |
| 6,116,528 | A | | 9/2000 | Schwelling |
| 6,141,883 | A | | 11/2000 | Mitchell et al. |
| 6,265,682 | B1 | | 7/2001 | Lee |
| 6,376,939 | B1 | | 4/2002 | Suzuki et al. |
| 6,418,004 | B1 | | 7/2002 | Mather et al. |
| 6,550,701 | B1 | | 4/2003 | Chang |
| 6,561,444 | B1 | | 5/2003 | Yokomine et al. |
| 6,601,787 | B1 | | 8/2003 | Langenecker |
| 6,655,943 | B1 | | 12/2003 | Peterson |
| 6,666,959 | B2 | | 12/2003 | Uzoh et al. |
| 6,676,460 | B1 | | 1/2004 | Motsenbocker |
| 6,698,640 | B2 | | 3/2004 | Hakozaki |
| 6,724,324 | B1 | | 4/2004 | Lambert |
| 6,802,465 | B1 | | 10/2004 | Norcott et al. |
| 6,979,813 | B2 | | 12/2005 | Avril |
| 6,983,903 | B2 | | 1/2006 | Chang |
| 6,997,408 | B2 | | 2/2006 | Watano |
| 7,025,293 | B2 | | 4/2006 | Matlin et al. |
| 7,040,559 | B2 | | 5/2006 | Matlin |
| 7,166,561 | B2 | | 1/2007 | Allen |
| 7,210,867 | B1 | | 5/2007 | Silverbrook |
| 7,213,780 | B2 | | 5/2007 | Chen |
| 7,311,276 | B2 | | 12/2007 | Matlin et al. |
| 7,520,452 | B2 | | 4/2009 | Watano et al. |
| 7,624,938 | B2 | | 12/2009 | Aries et al. |
| 7,631,822 | B2 | | 12/2009 | Matlin et al. |
| 7,631,823 | B2 | | 12/2009 | Matlin et al. |
| 7,631,824 | B2 | | 12/2009 | Matlin et al. |
| 7,635,102 | B2 | | 12/2009 | Matlin et al. |
| 7,661,614 | B2 | | 2/2010 | Matlin et al. |
| 7,663,769 | B2 | | 2/2010 | Hayashihara et al. |
| 7,712,689 | B2 | | 5/2010 | Matlin et al. |
| 2003/0016365 | A1 | | 1/2003 | Liess et al. |
| 2003/0042342 | A1 | | 3/2003 | Kroger et al. |
| 2004/0008122 | A1 | | 1/2004 | Michael |
| 2004/0069883 | A1 | | 4/2004 | Watanabe et al. |
| 2004/0159198 | A1 | | 8/2004 | Peot et al. |
| 2004/0194594 | A1 | | 10/2004 | Dils et al. |
| 2004/0226800 | A1 | | 11/2004 | Pierga |
| 2005/0046651 | A1 | | 3/2005 | Askren et al. |
| 2005/0150986 | A1 | | 7/2005 | Castronovo |
| 2005/0213106 | A1 | | 9/2005 | Weijers et al. |
| 2006/0016919 | A1 | | 1/2006 | Castronovo |
| 2006/0054725 | A1 | | 3/2006 | Matlin |
| 2006/0091247 | A1 | | 5/2006 | Matlin |
| 2006/0243631 | A1 | | 11/2006 | Duke |
| 2007/0007373 | A1 | | 1/2007 | Matlin |
| 2007/0025239 | A1 | | 2/2007 | Jain et al. |
| 2007/0063082 | A1 | | 3/2007 | Coleman |
| 2007/0080252 | A1 | | 4/2007 | Pierce |
| 2007/0087942 | A1 | | 4/2007 | Allen |
| 2007/0164135 | A1 | | 7/2007 | Zhong |
| 2007/0164138 | A1 | | 7/2007 | Allen |
| 2007/0215728 | A1 | | 9/2007 | Priester |
| 2007/0221767 | A1 | | 9/2007 | Matlin |
| 2007/0246582 | A1 | | 10/2007 | Aries et al. |
| 2007/0246586 | A1 | | 10/2007 | Matlin et al. |
| 2008/0093487 | A1 | | 4/2008 | Lee |
| 2008/0231261 | A1 | | 9/2008 | Dengler et al. |
| 2009/0025239 | A1 | | 1/2009 | Pan |
| 2009/0032629 | A1 | | 2/2009 | Aries et al. |
| 2009/0090797 | A1 | | 4/2009 | Matlin et al. |
| 2010/0051731 | A1 | | 3/2010 | Matlin et al. |
| 2010/0084496 | A1 | | 4/2010 | Matlin et al. |
| 2010/0102153 | A1 | | 4/2010 | Matlin et al. |
| 2010/0134805 | A1 | | 6/2010 | Pan |
| 2010/0170967 | A1 | | 7/2010 | Jensen et al. |
| 2010/0170969 | A1 | | 7/2010 | Jensen et al. |
| 2010/0176227 | A1 | | 7/2010 | Davis et al. |
| 2010/0181398 | A1 | | 7/2010 | Davis et al. |
| 2010/0213296 | A1 | | 8/2010 | Sued et al. |
| 2010/0213297 | A1 | | 8/2010 | Sued et al. |
| 2010/0213300 | A1 | | 8/2010 | Matlin et al. |
| 2010/0243774 | A1 | | 9/2010 | Hu et al. |
| 2010/0252661 | A1 | | 10/2010 | Matlin et al. |
| 2010/0252664 | A1 | | 10/2010 | Matlin et al. |
| 2010/0270404 | A1 | | 10/2010 | Chen |
| 2010/0282879 | A1 | | 11/2010 | Chen |
| 2010/0288861 | A1 | | 11/2010 | Cai et al. |
| 2010/0320297 | A1 | | 12/2010 | Matlin et al. |
| 2010/0320299 | A1 | | 12/2010 | Matlin et al. |
| 2011/0272504 | A1 | | 11/2011 | Matlin et al. |
| 2011/0272505 | A1 | | 11/2011 | Matlin et al. |
| 2011/0280642 | A1 | | 11/2011 | Ikeda et al. |
| 2011/0297769 | A1 | | 12/2011 | Matlin et al. |
| 2011/0297770 | A1 | | 12/2011 | Matlin et al. |

FOREIGN PATENT DOCUMENTS

| | | | |
|---|---|---|---|
| DE | 4121330 | | 1/1993 |
| DE | 4207292 | | 1/1993 |
| DE | 4237861 | | 5/1994 |
| DE | 4437348 | | 4/1996 |
| DE | 19835093 | | 2/1999 |
| DE | 202004000907 | | 5/2005 |
| DE | 102006036136 | | 1/2008 |
| DE | 202010001577 | U1 | 11/2010 |
| EP | 268244 | | 11/1987 |
| EP | 0392867 | | 10/1990 |
| EP | 562076 | | 9/1992 |
| EP | 524708 | | 1/1997 |
| EP | 0792691 | | 9/1997 |
| EP | 0818241 | | 1/1998 |
| EP | 856945 | | 1/1998 |
| EP | 855221 | | 7/1998 |
| EP | 1177832 | | 2/2002 |
| EP | 1195202 | | 4/2002 |
| EP | 2180290 | | 7/2008 |
| EP | 2022566 | | 2/2009 |
| GB | 1199903 | | 7/1970 |
| GB | 2171029 | | 8/1986 |
| GB | 2209963 | | 6/1989 |
| GB | 2440651 | | 2/2008 |
| GB | 2442942 | | 4/2008 |
| GB | 2451513 | | 2/2009 |
| JP | 5311911 | | 3/1978 |
| JP | 57-76734 | | 1/1982 |

| | | |
|---|---|---|
| JP | 57-070445 | 4/1982 |
| JP | 57-070445 U | 4/1982 |
| JP | 58-223448 | 12/1983 |
| JP | 59150554 | 8/1984 |
| JP | 61-000702 | 1/1986 |
| JP | 62183555 | 11/1987 |
| JP | 63-173342 | 11/1988 |
| JP | 2-277560 | 11/1990 |
| JP | H2-303550 | 12/1990 |
| JP | 04-157093 | 5/1992 |
| JP | 04-0180852 | 6/1992 |
| JP | 5-96198 | 4/1993 |
| JP | H05-092144 | 4/1993 |
| JP | 6-277548 | 10/1994 |
| JP | 7-299377 | 11/1995 |
| JP | 8-108088 | 4/1996 |
| JP | 8-131861 | 5/1996 |
| JP | 08-131962 | 5/1996 |
| JP | 08-16434 | 6/1996 |
| JP | 52-11691 | 1/1997 |
| JP | 9-38513 | 2/1997 |
| JP | 09075763 | 3/1997 |
| JP | 09-150069 | 10/1997 |
| JP | 9-262491 | 10/1997 |
| JP | 10-048344 | 2/1998 |
| JP | 11-216383 | 8/1999 |
| JP | 11-304942 | 11/1999 |
| JP | 2000346288 | 12/2000 |
| JP | 2002-239405 | 8/2002 |
| JP | 2002239405 | 8/2002 |
| JP | 2004-321840 | 11/2004 |
| JP | 2004321993 | 11/2004 |
| WO | 2005070553 | 8/2005 |
| WO | 2006019985 | 2/2006 |
| WO | 2006036370 | 4/2006 |
| WO | 2007109753 | 9/2007 |
| WO | 2007122364 | 11/2007 |
| WO | 2007137761 | 12/2007 |

OTHER PUBLICATIONS

ACCO Rexel, Mainstream 1050/2150/2250/3150/3250 and 3350, 115V Machines Illustrated Parts Lists and Services Instructions, Mar. 25, 2002, Issue No. 4.

ACCO Rexel, Deckside and Office 115V Machines Illustrated Parts Lists and Service Instructions, Aug. 18, 1999.

ACCO Rexel, Deckside and Office 230V Machines Illustrated Parts Lists and Service Instructions, Aug. 1, 2000.

GBC Shredmaster Service Manual, Part #6001054, referencing Models 2230S and 2250X Paper Shredders, Nov. 1997.

The Stationary and Business Machines—Japan, "DS-4000 by Carl Jimuki K.K.", Jun. 2003.

The Stationary and Business Machines—Japan, "NSE-501CN by Nakabayashi K.K.", Oct. 2004.

International Search Report and Written Opinion for PCT/US2011/031922 dated Oct. 6, 2011.

English Translation of Japanese Patent Application Publication No. 9-38513, published on Feb. 10, 1997.

U.S. Appl. No. 60/613,750, filed Sep. 27, 2004, Pierce.

U.S. Appl. No. 60/686,490, filed May 31, 2005, Pierce.

U.S. Appl. No. 60/688,285, filed Jun. 7, 2005, Pierce.

* cited by examiner

IN-RUSH CURRENT JAM PROOF SENSOR CONTROL

BACKGROUND OF THE INVENTION

1. Field of Invention

The present invention relates to shredders for destroying articles, such as documents, CDs, etc.

2. Description of Related Art

Shredders are well known devices for destroying substrate articles, such as documents, CDs, floppy disks, etc. Typically, users purchase shredders to destroy sensitive articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container. The shredder typically has a stated capacity, such as a number of sheets of paper (typically of 20 lb. weight) that may be shredded at one time; however, the feed throat of a typical shredder can receive more sheets of paper than the stated capacity. A common frustration of users of shredders includes feeding too many papers into the feed throat, only to have the shredder jam after it has started to shred the papers. To free the shredder of the papers, the user typically reverses the direction of rotation of the cutter elements via a switch until the papers become free. Occasionally, the jam may be so severe that reversing may not free the paper entirely, and the paper must be pulled out manually, which may be difficult with the paper bound between blades of the cutter elements. In some cases, when article(s) are inserted into the shredder that are too thick or irreversible, the shredder may be overloaded or overheated, and the motor of the shredder mechanism may stall and thus shut down.

In order to prevent such motor stall, some existing designs use other detection devices to anticipate a motor's current-limit. For example, such designs may include load meters (readings based on motor current), speed-based jam detectors, hall effect sensors (for reading motor speed), or other types of speed sensors (e.g., provided on the cutter shafts). In some existing cases, detection of possible overload or motor stall may be prevented by reversing the motor when the system becomes jammed. U.S. Pat. No. 4,495,456, entitled "Automatic Reversing System for Shredder," illustrates an example of such a machine.

Some shredders may employ a stall or overload detection circuit which monitors a motor's current draw to determine maximum capabilities of the shredding machine and to determine if/when a motor might stall. In such shredders, the idea is to prevent the motor from going into or remaining in a stall condition which not only draws excessive current, but also heats the motor prematurely. Traditionally, these circuits either have a delay or a limiting device (e.g., a thermistor) or have software to ignore the initial in-rush current drawn by the motor to prevent false positive reactions (for possible stalls or short-circuits).

For example, a first known traditional method for setting the overload detection threshold includes setting a fixed value close to the stall current of a machine at its cold state, and then determining if a motor's current draw is close to the fixed value (i.e., using a comparator) during operation. This first method may be effective on a "cold" motor, i.e., a motor that is not running The overload detection circuitry of this type of shredder will only trigger when the motor is stalled/about to stall (i.e., drawn current is close to the fixed value). However, as a motor heats during use, the amount of current being drawn by the motor tends to decrease, and AC fluctuations may occur. This first method is unable to track any decrease in drawn current as the motor heats or fluctuations. This means that a "hot" (i.e., working or rotating) motor will often stall before or without the overload detection circuitry detecting the event.

A second known method for overload detection is a calibration that is performed at the factory or during manufacture, in which a threshold of a shredder is adjusted to a specific load (e.g., sheet count) on that specific machine. This second method may be effective at preventing a user from operating above the ratings of the machine (before stalling), but it, too, can also not track variances in drawn motor current due to heat and/or AC fluctuations. This, in turn, causes the initial threshold to fluctuate, which can either allow excessive load on the system, or it can prematurely limit the user from operating the machine within its capabilities.

In other designs, assumptions have to be made using software based on time, or an extra thermal device has to be added to the motor to track motor temperature. For example, assumptions of the current thermal condition of the motor (and therefore the maximum load) could be approximated by a software algorithm. Such assumptions generally assume that all of the motors in mass-production have similar thermal characteristics and that the efficiencies of the cutting blocks are similar. However, such assumptions are generally incorrect. Although two motors (of the same model) can have similar measured temperatures, this does not equate to them having the same performance characteristics. Variances in material and assembly can change this relationship, for example. In addition, variations in line voltage and frequency are not generally accounted for. This can significantly impact the performance of the motor and impact the stall current reading relative to a fixed threshold.

As noted above, the inrush current initially drawn by a motor when a shredder mechanism is turned on is ignored in prior designs to prevent false readings of overload. However, as described further herein, this disclosure determines and uses this inrush current to determine parameters related to the motor as well as occurrences at which the motor will stall (e.g., due to a jam in the shredder).

SUMMARY OF THE INVENTION

One aspect of the invention provides a shredder having: a housing having a throat for receiving at least one article to be shredded and a shredder mechanism received in the housing and including an electrically powered motor and cutter elements. The shredder mechanism enables the at least one article to be shredded to be fed into cutter elements and the motor is operable to drive the cutter elements in a shredding direction so that the cutter elements shred the articles fed therein upon receiving electrical power via a power source. The shredder also has a current sensor for detecting current flowing through the motor and a controller coupled to the motor for controlling operation of the motor. The controller is also coupled to the current sensor and configured to detect at least an inrush current supplied to the motor for each shredding event. The controller is configured to set a parameter of the shredder based on the detected inrush current supplied to the motor.

Another aspect of the invention provides a method for monitoring operation of a shredder, the shredder comprising a housing having a throat for receiving at least one article to be shredded and a shredder mechanism received in the housing and including an electrically powered motor and cutter elements. The shredder mechanism enables the at least one article to be shredded to be fed into cutter element and the motor is operable to drive the cutter elements in a shredding direction so that the cutter elements shred the articles fed therein upon receiving power via a power source. The shredder has a current sensor for detecting current flowing through the motor, and a controller coupled to the current sensor and coupled to the motor for controlling operation of the motor. The method includes:

powering the motor with electrical power via the power source;

detecting with the controller an inrush current supplied to the motor for each shredding event, and setting with the controller a parameter of the shredder based on the determined inrush current supplied to the motor.

Yet another aspect of the invention provides a computer program product having: a computer-usable data carrier storing instructions that, when executed by a computer, cause the computer to perform a method for monitoring operation of a shredder, the shredder including a housing having a throat for receiving at least one article to be shredded, a shredder mechanism received in the housing and including an electrically powered motor and cutter elements, the shredder mechanism enabling the at least one article to be shredded to be fed into cutter elements and the motor being operable to drive the cutter elements in a shredding direction so that the cutter elements shred the articles fed therein upon receiving power via a power source, a current sensor for detecting current flowing through the motor, and a controller coupled to the current sensor and coupled to the motor for controlling operation of the motor; the method including:

detecting with the controller an inrush current supplied to the motor for each shredding event, and setting with the controller a parameter of the shredder based on the determined inrush current supplied to the motor.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

As will become further evident in the description below, the herein described jam proof sensor is defined as a sensor that is configured to consider an initial inrush current of a motor when the motor is initially supplied with power to operate (e.g., rotate) in order to determine at what current draw the motor will stall. The initial inrush current is used to set a parameter (e.g., overload detection threshold or maximum thickness threshold) of the shredder so that stalling or overheating can be prevented (i.e., before reaching a current draw at which the motor will stop).

Figure 1:
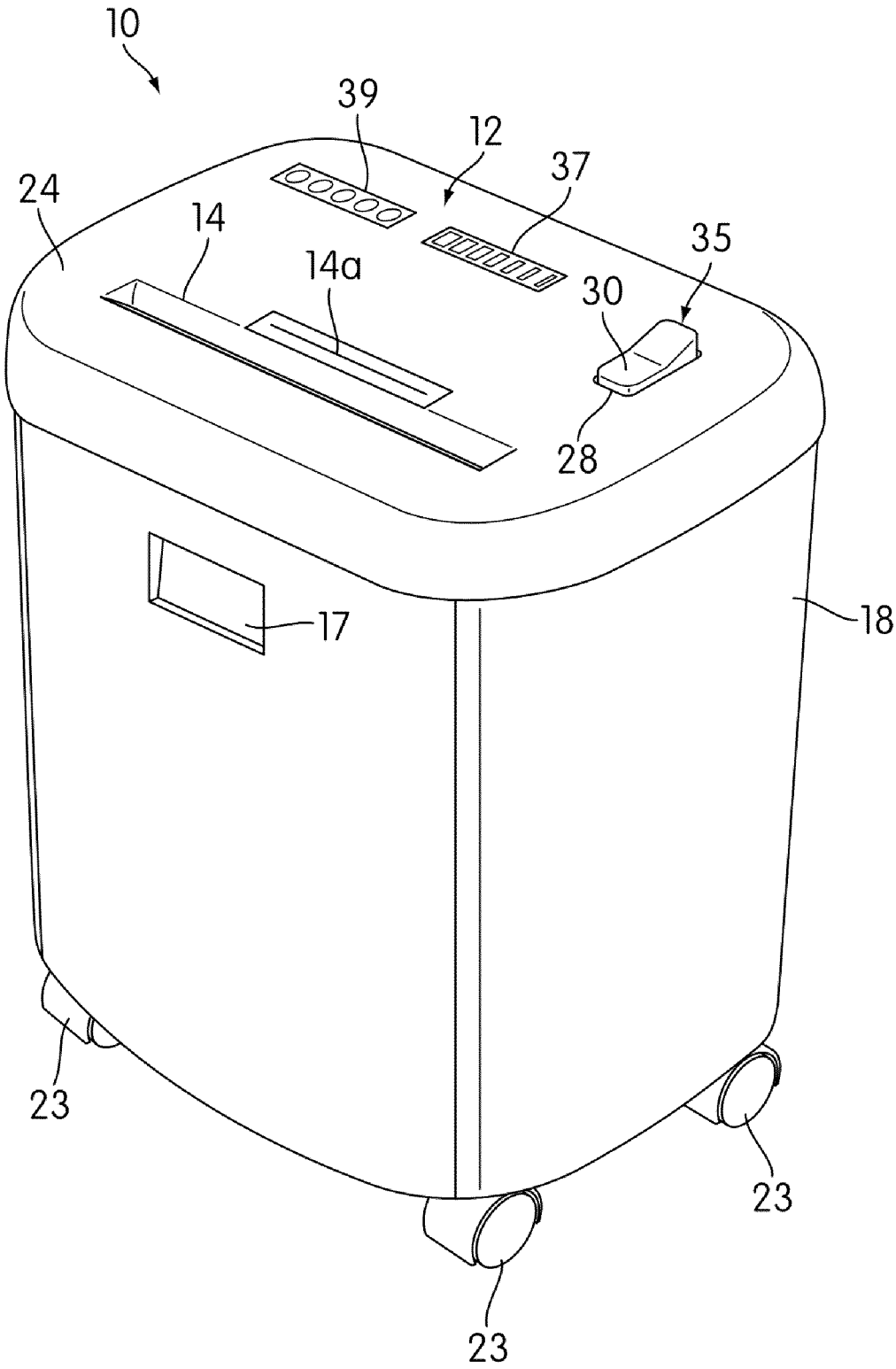
FIG. 1 is a perspective view of a shredder constructed in accordance with an embodiment of the invention.

FIG. 1 is a perspective view of a shredder apparatus 10 constructed in accordance with an embodiment of the present invention. The shredder 10 is designed to destroy or shred articles such as paper, paper products, CDs, DVDs, credit cards, and other objects. The shredder 10 comprises a shredder housing 12 that sits on top of a container 18, for example. The shredder housing 12 comprises at least one input opening 14 on an upper side 24 (or upper wall or top side or top wall) of the housing 12 for receiving materials to be shredded. The input opening 14 extends in a lateral direction, and is also often referred to as a throat. The input opening or throat 14 may extend generally parallel to and above a shredder mechanism 20 (described below, and shown in FIG. 4). The input opening or throat 14 may be relatively narrow, so as to prevent overly thick items, such as large stacks of documents, from being fed into therein. However, the throat 14 may have any configuration. In some cases, one or more additional or second input openings 14*a* may be provided in shredder housing 12. For example, input opening 14 may be provided to receive paper, paper products, and other items, while a second input opening 14*a* may be provided to receive objects such as CDs and DVDs, credit cards, etc. The upper wall 24 may be molded from a plastic material or any other material. The shredder housing 12 and its upper wall 24 may have any suitable construction or configuration.

Figure 2:
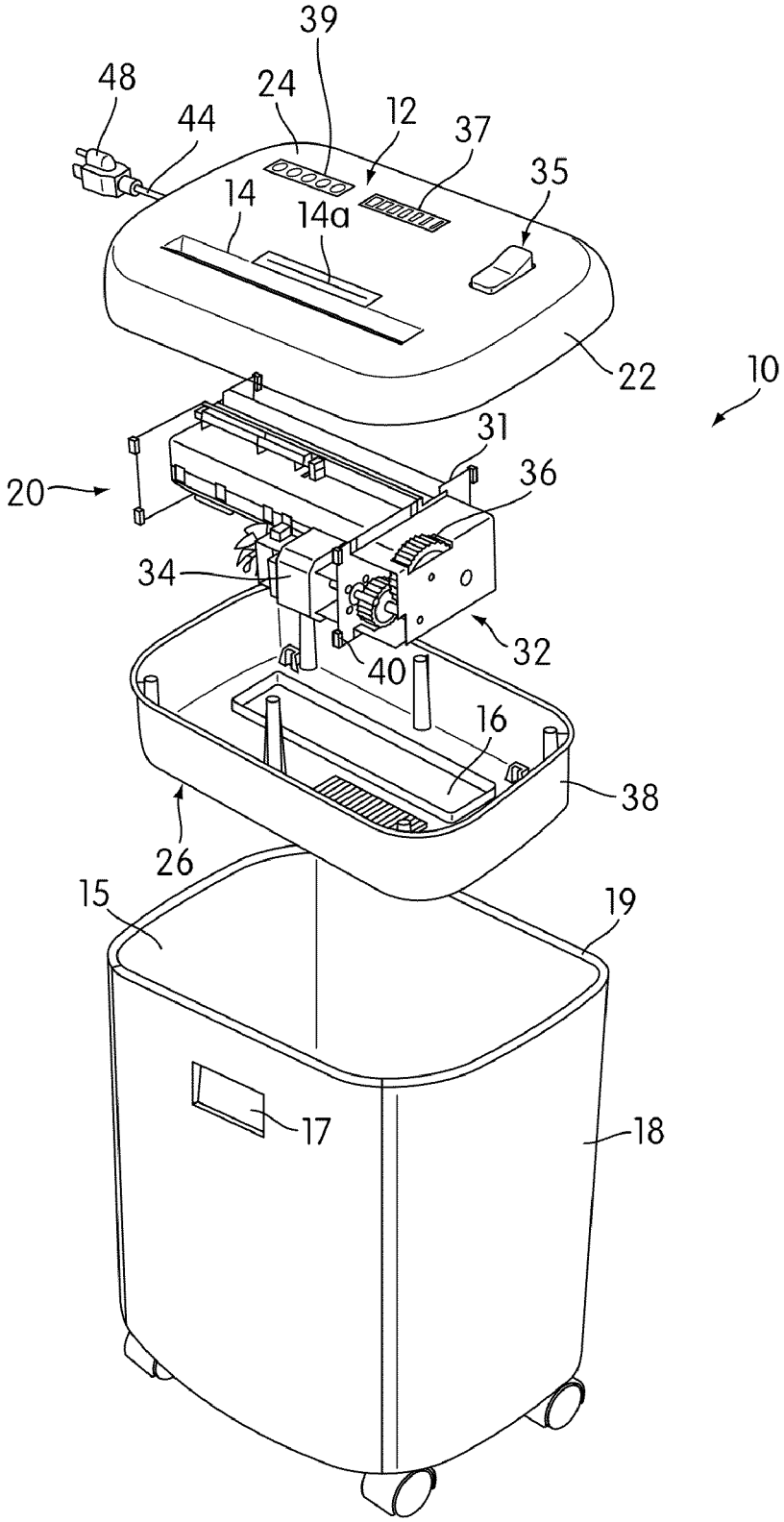
FIG. 2 is an exploded perspective view of the shredder of FIG. 1.

Shredder housing 12 also comprises an output opening 16 on a lower side 26 (or bottom side or bottom wall or underside or bin side), shown in FIG. 2. In an embodiment, shredder housing 12 may include a bottom receptacle 38 with lower side 26 to receive shredder mechanism 20 (along with a motor 34, transmissions, etc.) therein. For example, the bottom receptacle 38 may have a bottom wall forming lower side 26, four side walls and an open top. Bottom receptacle 38 is generally defined as a device or part of housing 12 for at least assisting in securing the shredder mechanism 20 within and/or to the housing 12. The bottom receptacle 38 may be molded from a plastic material or any other material. Bottom receptacle 38 may be affixed to the underside of the upper side 24 or top wall base fasteners, for example. The receptacle 38 has output opening 16 in its bottom side 26 or bottom wall through which shredded particles are discharged. Though lower side 26 is shown as comprising a bottom receptacle 38, the configuration, shape, or design of lower side 26 or receptacle 38 should not be limiting. Generally speaking, the shredder 10 may have any suitable construction or configuration and the illustrated embodiments provided herein are not intended to be limiting in any way. In addition, the term "shredder" or "shredder apparatus," used interchangeably throughout this specification, are not intended to be limited to devices that literally "shred" documents and articles, but instead intended to cover any device that destroys documents and articles in a manner that leaves such documents and articles illegible and/or useless.

Figure 4:
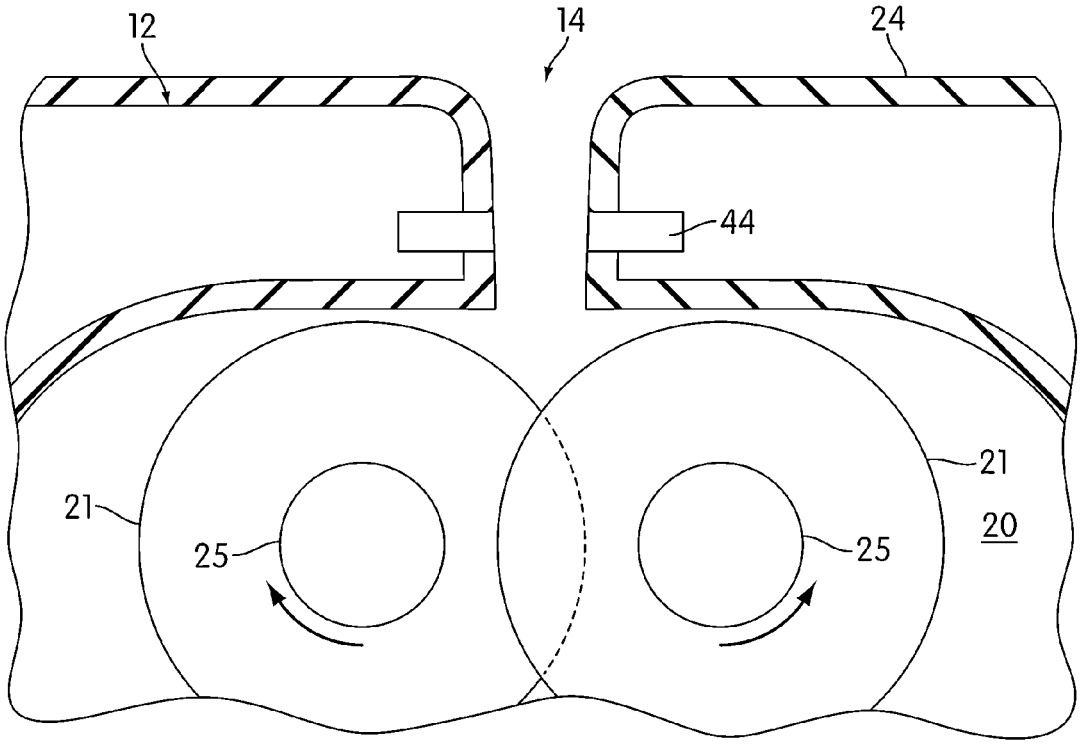
FIG. 4 is a cross-section showing a schematic illustration of a detector and shredder mechanism in the shredder of FIG. 1 in accordance with an embodiment of the present invention.

As noted, the shredder 10 also comprises a shredder mechanism 20 (shown generally in FIG. 2) in the shredder housing 12. When articles are inserted into the at least one input opening or throat 14, they are directed toward and into shredder mechanism 20 (e.g., see FIG. 4). "Shredder mechanism" is a generic structural term to denote a device that destroys articles using at least one cutter element. Destroying may be done in any particular way. For example, the shredder mechanism may include at least one cutter element that is configured to punch a plurality of holes in the document or article in a manner that destroys the document or article. Shredder mechanism 20 includes a drive system 32 with at least one motor 34, such as an electrically powered motor, and a plurality of cutter elements 21 (shown in FIG. 4). The drive system 32 may have any number of motors and may include one or more transmissions. The motor 34 may be an AC induction motor, for example. In another embodiment, the motor may be a DC motor, a permanent magnet motor, a universal motor, or any other type of motor. In the illustrated embodiment, the cutter elements 21 are generally mounted on a pair of parallel mounting shafts 25, as shown in FIG. 4. The motor 34 operates using electrical power to rotatably drive first and second rotatable shafts 25 of the shredder mechanism 20 and their corresponding cutter elements 21 through a conventional transmission 36 so that the cutter elements 21 shred or destroy materials or articles fed therein via throat 14, and, subsequently, deposit the shredded materials into opening 15 of container 18 via the output opening 16. The operation and construction of such a shredder mechanism 20 are well known and need not be described herein in detail. Generally, any suitable shredder mechanism 20 known in the art or developed hereafter may be used.

The shredder mechanism 20 may also include a sub-frame 31 for mounting the shafts 25, motor 34, and transmission 36 of the drive system 32 and cutter elements 21. In some cases, the subframe 31 may be connected to both an upper side 24 (e.g., on an underside of upper side 24) and a lower side 26 (e.g., on an upper side of receptacle 38) to secure the shredder mechanism 20 within or to the housing 12. For example, one or more connecting portions 40 may be provided to secure or fasten the frame 31 thereto. Generally, devices such as fasteners, screws, or bolts, and nuts may be used to secure the frame 31 to the upper side 24 and lower side 26 of housing 12. Additionally and/or alternatively, shock absorbing elements, vibration absorbing elements, and/or springs may be used when connecting the shredder mechanism 20 and shredder housing 12.

Also, the plurality of cutter elements 21 may be mounted on first and second rotatable shafts 25 in any suitable manner. For example, in an embodiment, the cutter elements 21 are rotated in an interleaving relationship for shredding paper sheets and other articles fed therein. In an embodiment, the cutter elements 21 may be provided in a stacked relationship. The operation and construction of such a shredder mechanism 20 is well known and need not be discussed herein in detail. As such, the at least one input opening or throat 14 is configured to receive materials inserted therein to feed such materials through the shredder mechanism 20 and to deposit or eject the shredded materials through output opening 16.

Shredder housing 12 is configured to be seated above or upon the container 18. The container 18 is formed of molded plastic material or any other material. The container 18 includes a bottom wall, four side walls, and an open top, for example. As shown in FIG. 2, shredder housing 12 may comprise a detachable paper shredder mechanism that sits atop container 18. That is, in an embodiment, the shredder housing 12 may be removed in relation to the container 18 to ease or assist in emptying the container 18 of shredded materials. In an embodiment, shredder housing 12 comprises a lip 22, seat, or other structural arrangement that corresponds in size and shape with a top edge 19 of the container 18. The container 18 receives paper or articles that are shredded by the shredder 10 within its opening 15. More specifically, after inserting materials into input opening 14 for shredding by cutter elements 21, the shredded materials or articles are deposited from the output opening 16 on the lower side 26 of the shredder housing 12 into the opening 15 of container 18. The container 18 may be a waste bin, for example.

In an embodiment, the shredder 10 may comprise roller members 23 in the form of wheels or casters to assist in moving the shredder 10. For example, the container 18 may include wheels on its bottom (e.g., near the corners, as shown in FIG. 1) so that the shredder 10 can be transported from one place to another.

In an embodiment, the container 18 may be positioned in a frame or a freestanding housing (e.g., formed of molded plastic or other material) beneath the shredder housing 12. For example, the frame may be used to support the shredder housing 12 as well as comprise a container receiving space so that the container 18 may be removed therefrom. The frame may include a bottom wall, three side walls, an open front and an open top. The side walls of the frame provide a seat on which the shredder housing 20 is removably mounted. For example, in an embodiment, a container 18 may be provided to slide like a drawer with respect to a frame (e.g., a pull out bin), be hingedly mounted to a frame, or comprise a step or pedal device to assist in pulling or removing it therefrom from a front or side of the frame. Container 18 may comprise an opening, a handle, or a recess 17 to facilitate a user's ability to grasp the bin (or grasp an area approximate to the recess 17), and thus provide an area for the user to easily grasp to separate the container 18 from the shredder housing 12, thereby providing access to shredded materials. The container 18 may be substantially or entirely removed from being in an operative condition with shredder housing 12 in order to empty shredded materials such as chips or strips (i.e., waste or trash) located therein. In an embodiment, the shredder 10 may comprise one or more access openings (not shown), for example, in part of the container or part of the shredder housing, to allow for the deposit of larger articles therein.

Generally the terms "container," "waste bin," and "bin" are defined as devices for receiving shredded materials discharged from the output opening 16 of the shredder mechanism 20, and such terms are used interchangeably throughout this specification. However, such terms should not be limiting. Container 18 and/or frame may have any suitable construction or configuration, and the illustrated embodiment is not limiting.

Typically, the power supply to the shredder 10 will be a standard power cord 44 with a plug 48 on its end that plugs into a standard AC outlet. Also, a control panel may be provided for use with the shredder 10. Generally, the use of a control panel is known in the art. As shown in FIG. 1, a power switch 35 or a plurality of switches may be provided to control operation of the shredder 10. The power switch 35 may be provided on the upper side 24 of the shredder housing 12, for example, or anywhere else on the shredder 10. The upper side 24 may have a switch recess 28 with an opening therethrough. An on/off switch 35 includes a switch module (not shown) mounted to housing 12 underneath the recess 28 by fastening devices, and a manually engageable portion 30 that moves pivotally within recess 28 (i.e., a rocker switch). The switch module has a movable element (not shown) that connects to the manually engageable portion 30 to move the switch module between its states. Movement of the manually engageable portion of switch 35 moves the switch module between states. In the illustrated embodiment shown in FIG. 2, the switch module connects the motor 34 to the power supply. This connection may be direct or indirect, such as via a controller 42 (shown in FIG. 3). The term "controller" is used to define a device or microcontroller having a central processing unit (CPU or microprocessor) and input/output devices that are used to monitor parameters from devices that at operatively coupled to the controller 42 (e.g., field-programmable gate array). The input/output devices also permit the CPU to communicate and control the devices (e.g., one or more sensors, such as current sensor 46, described below) that are operatively coupled to the controller 42. The controller 42 may be one controller or comprises multiple controllers. For example, in an embodiment, each one of the multiple controllers may be provided in shredder 10 for one or more specific functions. At least one controller is coupled to current sensor 46 and/or used to detect inrush current. For example, in an embodiment, the controller may be a part of a separate, distinct system that is designed for monitoring the current sensor 46 and motor 34. Also, the controller (and its related components) for the current sensor 42 may be added to an existing machine and/or provided at the time manufacturing. The controller 42 as shown and described is used for explanatory purposes only and should not be limiting. As is generally known in the art, the controller 42 may optionally include any number of storage media such as memory or storage for monitoring or controlling the sensors coupled to the controller.

Figure 3:
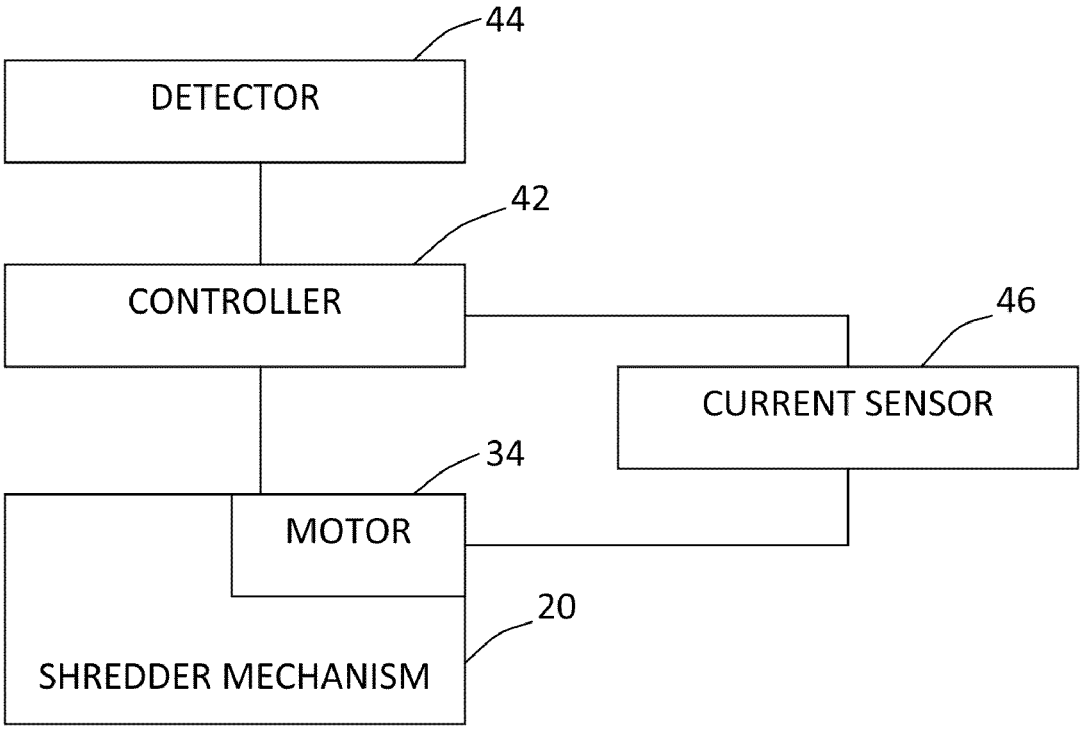
FIG. 3 is a schematic illustration of an embodiment of a detector, a controller, a current sensor, and a shredder mechanism with a motor, in accordance with an embodiment of the invention.

The controller 42 likewise communicates with the motor 34 of the shredder mechanism 20, as shown by the schematic illustration in FIG. 3. When the switch 35 is moved to an on position, the controller 42 can send an electrical signal to the drive of the motor 34 (e.g., contacts in the switch module are closed by movement of the manually engageable portion 30 and the movable element to enable a delivery of electrical power to the motor 34) so that it rotates the cutting elements 21 of the shredder mechanism 20 in a shredding direction, thus enabling paper sheets to be fed in the throat 14 to be shredded. Additionally or alternatively, when the switch 35 is in an on position, the switch 35 may be set to an idle, standby, or ready position, which communicates with the control panel. The idle or ready position may correspond to selectively activating the shredder mechanism 20, for example. Such a position may allow the controller 42 to selectively enable the operation of the shredder mechanism 20 based on the detection of the presence or insertion of at least one article (e.g., paper) in the throat 14 by or based on a waste level or bin full sensing device. The switch 35 may also be moved to an off position (e.g., contacts in the switch module are opened to disable the delivery of electric power to the motor 34), which causes the controller 42 to stop operation of the motor 34. Alternatively, the switch may be coupled to a controller, which in turn controls a relay switch, TRIAC, etc., for controlling the flow of electricity to the motor 34.

The switch module contains appropriate contacts for signaling the position of the switch's manually engageable portion. As an option, the switch 35 may also have a reverse position that signals the controller to operate the motor 34 in a reverse manner. This would be done by using a reversible motor and applying a current that is of reverse polarity relative to the on position. The capability to operate the motor 34 in a reversing manner is desirable to move the cutter elements 21 in a reversing direction for clearing jams, for example. To provide each of the noted positions, the switch 35 may be a sliding switch (e.g., sliding laterally), a rotary switch, or a rocker switch. For example, in an off position the manually engageable portion and the movable element could be located generally in the center of the switch recess, and the on and reverse positions would be on opposing lateral sides of the off position. A middle or center position could be an idle or standby position. Also, the switch 35 may be of the push switch type that is simply depressed to cycle the controller through a plurality of conditions. Additionally, the controller may determine that throat 14 (e.g., via one or more sensors) is not clear of articles, and, thus, operate the motor 34 in a reverse direction (e.g., for a short period of time) so as to clear any remaining articles (or parts thereof) from the throat 14 of the shredder 10.

Generally, the construction and operation of the switch 35 and controller 42 for controlling the motor are well known and any construction for these may be used. For example, a touch screen switch, membrane switch, or toggle switches are other examples of switches that may be used. The switch need not be mechanical and could be of the electro-sensitive type. Also, the switch need not have distinct positions corresponding to on/off/idle/reverse, and these conditions may be states selected in the controller by the operation of the switch. Likewise, such a switch may be entirely omitted, and the shredder can be started based on insertion of an article to be shredded.

Any of the conditions could also be signaled by lights, on a display screen, or otherwise. For example, in an embodiment, one or more indicators such as indicator 37 or 39 (shown in FIG. 1) may be included to provide a warning signal to the user, such as an audible signal and/or a visual signal. In an embodiment, and as further described later, indicator 37 may comprise a sheet capacity indictor that progressively indicates the thickness of article(s) or document(s) being inserted into the opening 14 so as to prevent overloading and possible jams. U.S. Application Publication No. 20090090797 A1, Ser. No. 11/867,260, filed on Oct. 4, 2007 and assigned to the same assignee (Fellowes, Inc.), illustrates and describes such a progressive system, and is hereby incorporated by reference in its entirety. In an embodiment, indicator 39 may comprise a number of indicators corresponding to functions of the shredder, such as, but not limited to: overheating, bin open, bin full, paper jam, and flashing indicators (such as when the shredder has stopped or sensed a condition).

As shown in the schematic illustration of FIG. 3, shredder 10 further comprises a current sensor 46 for detecting current flowing through the motor 34. The current sensor 46 may be integrated within the controller 42 or it may be separate from the controller 42. The controller 42 is operatively coupled to the current sensor 46 and is configured to detect at least an initial amount of current supplied to the motor 34 for each shredding event. For purposes of this disclosure, a "shredding event" is defined as a period in which electrical power is received by the motor 34 to rotatably drive the first and second rotatable shafts 25 of the shredder mechanism 20. That is, when switch 35 is turned to an on position to rotate the shredder mechanism 20, the shredding event begins. The shredding event ends when the motor 34 no longer receives power to rotate the shredder mechanism 20 (e.g., when the switch 35 is moved to an off position). Alternatively, the shredder mechanism 20 may be set to be selectively activated (e.g., upon detection of an article being inserted into the throat 14 by detector 44) with the switch 35 in an idle or standby position. Even though switch 35 may be set to an idle, standby, or ready position for selective activation, and power is being supplied to the shredder 10, power is not being used by the motor 34 to drive the shafts 25. Thus, a shredding event is not occurring. However, if the controller 24 instructs the motor 34 to activate the shredder mechanism 20, for example, upon receipt of an article in the throat 14, then the motor 34 receives electrical power and in turn rotates the shredder mechanism 20. The motor 34 may stop rotation after the article is no longer detected or after a delay period after it is no longer detected (e.g., the article has been shredded). Thus, the shredding event lasts the period from which the controller 42 controls operation of the motor 34 and power is drawn by the motor 34 to rotate the mechanism 20, until the controller 42 stops operation of the motor 34.

Figure 5:
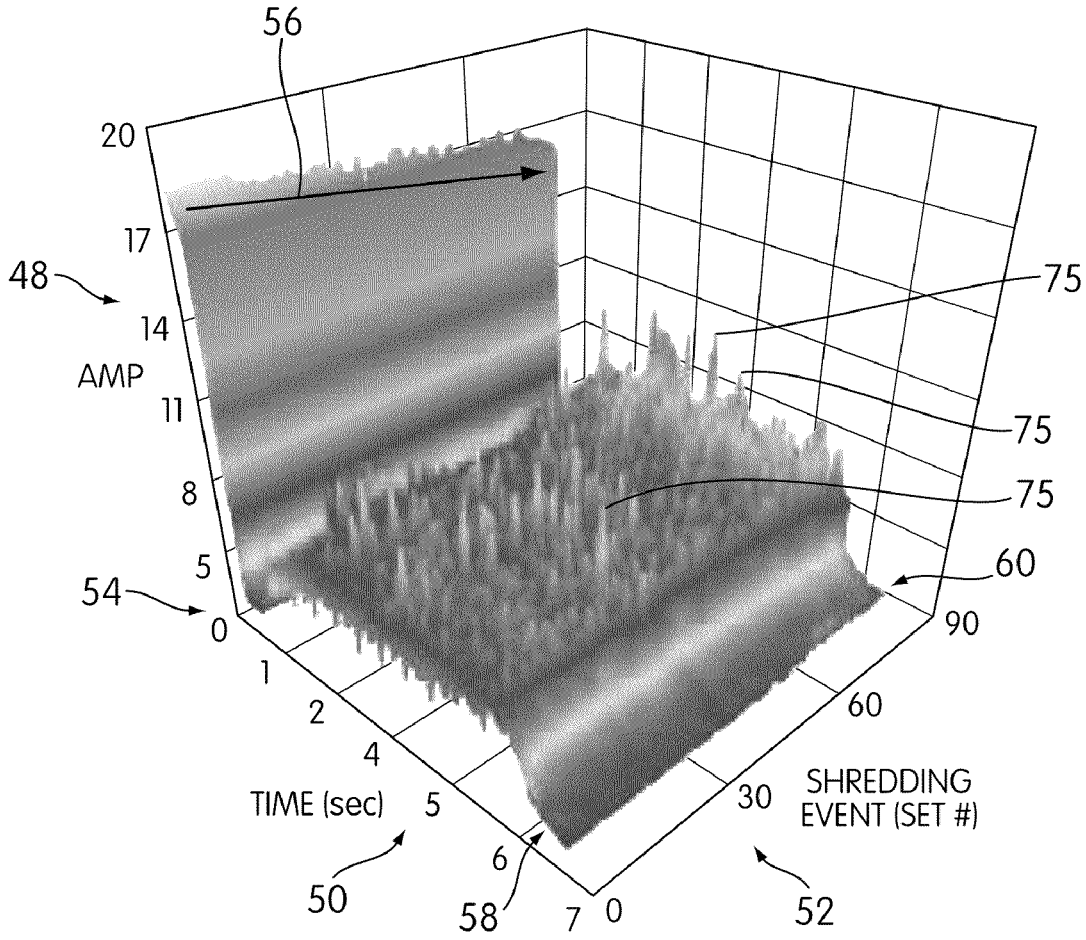
FIG. 5 is a 3-D graph illustrating relationships between current, time, and shredding events in accordance with embodiments of the invention.

When a shredding event begins, the controller 42 detects an initial amount of current that is supplied to the motor 34. In the art, this initial amount of current is known as "inrush" current. Inrush current is the maximum input current drawn by an electrical device when it is first turned on or first draws power (i.e., when power is supplied to the motor 34 to rotate the shredder mechanism 20, which can be for each shredding event). The level of inrush current relative to motor stall/run may vary based on motor type, but any inductive load has an inrush. For example, FIG. 5 is an exemplary 3-D graph illustrating relationships between current (noted as 48, in Amps), time (noted as 50, in seconds (sec)), and shredding events (noted as 52, in numbers (#s)). The graph provides data relating to an AC induction motor. It is noted that the data presented throughout this disclosure is related to using an AC induction motor; however, as noted above, the methods and concepts described herein should not be limited to a specific type of motor. More specifically, FIG. 5 shows a series of shredding events using a machine such as shredder 10. At zero seconds, there is no load or power supply (i.e., zero current) drawn by the motor of the shredder mechanism, as indicated by arrow 54. When a shredding event begins, there is a large current spike—i.e., an initial or inrush current—that is supplied to/drawn by the motor, as shown by arrow 56. It is this measured or detected current that is determined (e.g., using current sensor 46) and recorded for use by the controller (further described below). When a shredding event has ended, e.g., when there is no article present in the throat and the controller instructs the motor to stop rotation of the shredder mechanism, the current gradually decreases back to zero Amps, as shown by arrows 58 and 60.

Further visual inspection of the graph of FIG. 5 shows a slight decrease in inrush current (e.g., see arrow 56) as the number 52 of shredding events occur. Inrush current is proportional to peak forward torque (e.g., feed forward torque) and inversely proportional to motor temperature. That is, as inrush current decreases, the peak forward torque decreases. In contrast, as inrush current decreases, motor temperature increases. Peak forward torque is the maximum amount of torque that a motor can deliver to a load prior to stalling. For example, for an AC induction motor, the peak torque may be approximately 80 percent (%) of the rated speed. In an AC induction motor, the peak forward torque may be a torque the motor will deliver if its shaft is prevented from turning (e.g., such as in the case of a jam in the shredder mechanism 20). Alternatively, when article(s) that are too thick are inserted into the throat of the shredder, the motor may work harder and the amount of torque required to rotate the shafts and cutter elements may increase near peak forward torque. In particular, if the motor is delivering substantially near or at peak forward torque, the motor may be overloaded to stall operation and/or the motor temperature will be greatly increased. Increases in motor temperature—due to high torques, thick articles, repeated use, etc.—may also be more likely to cause stalling due to overheating. The inrush current is approximately equal to the peak motor stall current. Based on such information and knowing that motor stall can be a problem and/or inconvenience for users, this disclosure provides a method for measuring the inrush current for each shredding event, so that, should the inrush current change (and thus the peak forward torque and/or motor temperature at which stalls may occur will also change), the controller 42 is configured to set a parameter of the shredder 10 based on the detected initial amount of current (inrush current) supplied to the motor 34 for each shredding event.

Figure 6:
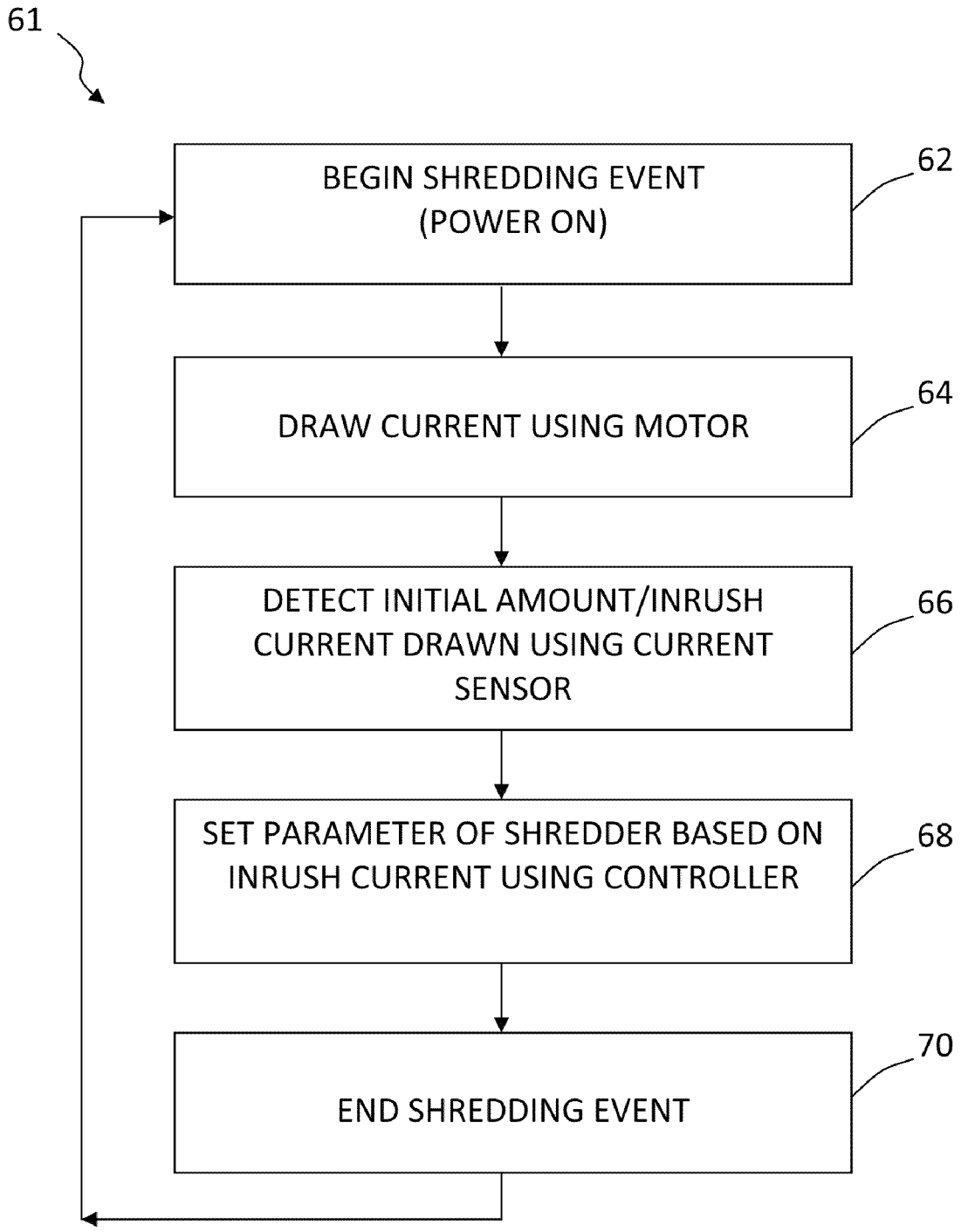
FIG. 6 is a flow diagram of a method for monitoring operation of a shredder in accordance with an embodiment of the invention.

FIG. 6 shows the method 61 for monitoring operation of shredder 10 via motor 34. At 62, a shredding event begins and power is turned on, i.e., the motor 34 is supplied with power via the power source in order to rotate the shredder mechanism 20. This may be done by the switch 35 being turned to an on position or by one or more sensors sensing an article for shredding. The motor draws current at 64. At 66, the inrush current drawn or supplied to the motor for each shredding event is determined or detected using the current sensor 46. Then, at 68, the controller 42 sets a parameter of the shredder based on the determined inrush current at 66 (if needed). The shredding event ends as shown at 70, and the process repeats for each shredding event.

In an embodiment, the parameter of the shredder may not need to be set (or reset) for each consecutive shredding event. For example, the detected inrush current for a first shredding event may be substantially equal or similar to the detected inrush current for a second, consecutive shredding event. Thus, the parameter may remain at its current setting. Also, in embodiments, two or more parameters may be set (or reset) based on the detected inrush current supplied to the motor. Logic or other algorithms may be used with the shredder 10 to make such determinations. As such, it is to be understood that the parameter examples described further below are not meant to be limiting.

The parameter set by the controller for each shredding event (if setting of such a parameter is needed) is designed to be adjusted in real-time relative to the maximum capabilities of the machine so that elements affecting the working operation of the motor 34 during shredding events are accounted or compensated for. The real-time or instantaneous adjustment of the parameter allows for a more accurate determination of when motor stalling may occur. Additional advantages of setting the parameter based on the inrush current are further described below.

Figure 7:
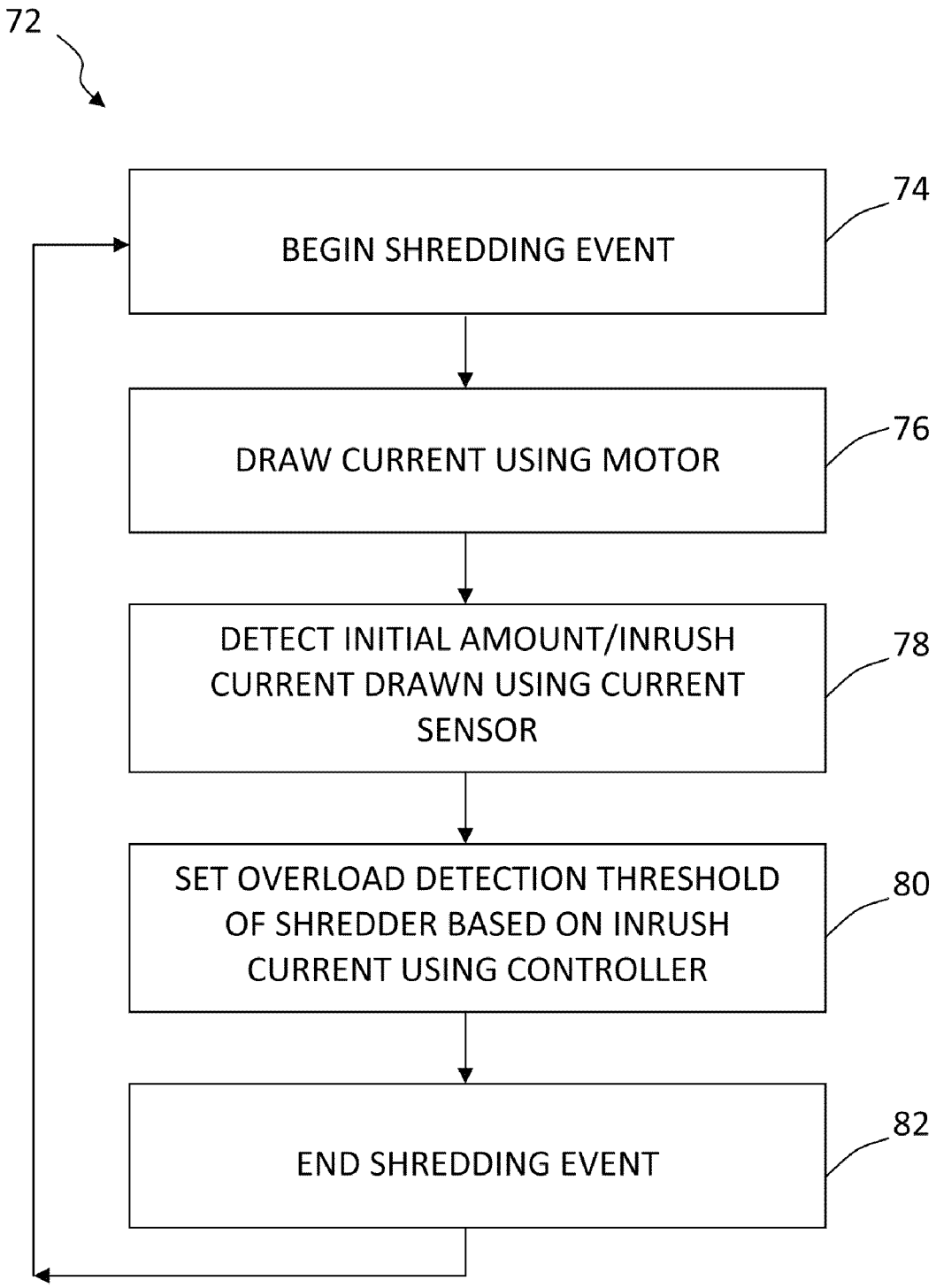
FIG. 7 is a flow diagram of a method for setting of an overload detection threshold for the shredder.

In an embodiment, the parameter set by the controller 42 may be an overload detection threshold at or before which the motor will stall. That is, the overload detection threshold may be set to a limit that is substantially equal to or less that a maximum load of the motor before stalling will occur. The "maximum load" of a motor can refer to either an amount of mechanical work the motor is performing (e.g., an amount of torque applied to the shafts 25 through each revolution) or an electrical load (e.g., resistance) of the motor. The load may affected by any number of variances (torque, temperature, frequency, etc.). Upon detection by the controller 42 that a load on the motor 34 is substantially equal to or greater than the overload detection threshold, the controller 42 is configured to limit the electrical power to the motor 34, thereby preventing the motor 34 from driving the cutter elements 21 in the shredding direction. As previously noted, the controller is configured to adjust or set the overload detection threshold based on the detected inrush current for each shredding event in real-time. FIG. 7 is a flow diagram of a method 72 for setting of this overload threshold. As shown in FIG. 6, the method 72 of FIG. 7 begins with a shredding event at 74, i.e., the motor 34 is supplied with power via the power source in order to rotate the shredder mechanism 20. The motor draws current at 76. At 78, the inrush current drawn or supplied to the motor for each shredding event is determined or detected using the current sensor 46. Then, at 80, the controller 42 sets the overload detection threshold of the shredder based on the determined inrush current at 78 (if needed). The shredding event ends as shown at 82, and the process repeats for each shredding event.

The method or algorithm used to set the overload detection threshold should not be limiting. In an embodiment, the overload detection threshold may be directly or indirectly set based on the inrush current detected. In an embodiment, the overload detection threshold is set at a fraction of the detected inrush current. For example, if the detected inrush current is detected and records to be 17 Amps, the overload detection threshold may be set at a percentage (e.g., approximately 90% (−15.5 Amps) or approximately 70% (−12 Amps)), so that the motor will be reduced or prevented from drawing its peak motor stall current.

By monitoring, in real time, the peak inrush current of the motor for each shredding event, the herein disclosed system and method can effectively determine the maximum capability of the motor at a given instant. The system and method eliminate design assumptions and limitations typically set by using fixed limits or factory calibration methods for overload detection, as described in the Related Art section. For example, in the previously described two traditional methods, during manufacture and/or before distribution, the threshold either has to be calibrated on the line, or a fixed value has to be established during the design phase. Calibrating on the production line requires paper (waste), and introduces margin for error. The shredder 10 does not require the need for a shredding operation (e.g., shredding paper with shredder mechanism 20) at the factory in order to set the current limit threshold (as may be the case in some prior art methods), because the current limit threshold is set based on the inrush current detection. Also, using a fixed current limit setting does not compensate for variability during cutting block assembly. For example, as shown in FIG. 5, the inrush current (and thus the peak motor stall current) may change during operation of the shredder 10. By tracking this change, the limitations of the machine can be observed and one or more parameters of the shredder 10 can be adjusted accordingly.

Using the herein described method and devices also eliminates the need for additional components or sensors for sensing performance characteristic(s) of the motor 34. The system will know the capabilities of the machine regardless of other characteristics. For example, the shredder 10 automatically compensates for motor heat, line voltage, frequency variations, as well as for component tolerances and assembly variances. There is no need for a motor temperature sensor to detect the temperature of the motor, because the overload detection threshold is set based on the inrush current, and the motor would not reach a peak temperature before this threshold. Of course, although such sensors are not required, in an embodiment, the shredder 10 may include one or more sensors (not shown) for sensing a performance characteristic (e.g., temperature) of the motor 34. Monitoring such a performance characteristic is generally known in the art and therefore is not explained in detail herein.

From a development/sales point of view, this system and method may be beneficial when developing shredders for those markets which operate in both 50 & 60 Hertz (Hz) frequencies (e.g., such as in Japan). As shown and described with reference to FIG. 7, for example, changes in frequency and voltage affect the amount of current and power used by the machine. Because the overload threshold parameter is set based on the inrush current, the peak motor stall current will not be affected by these fluctuating characteristics.

Figure 8:
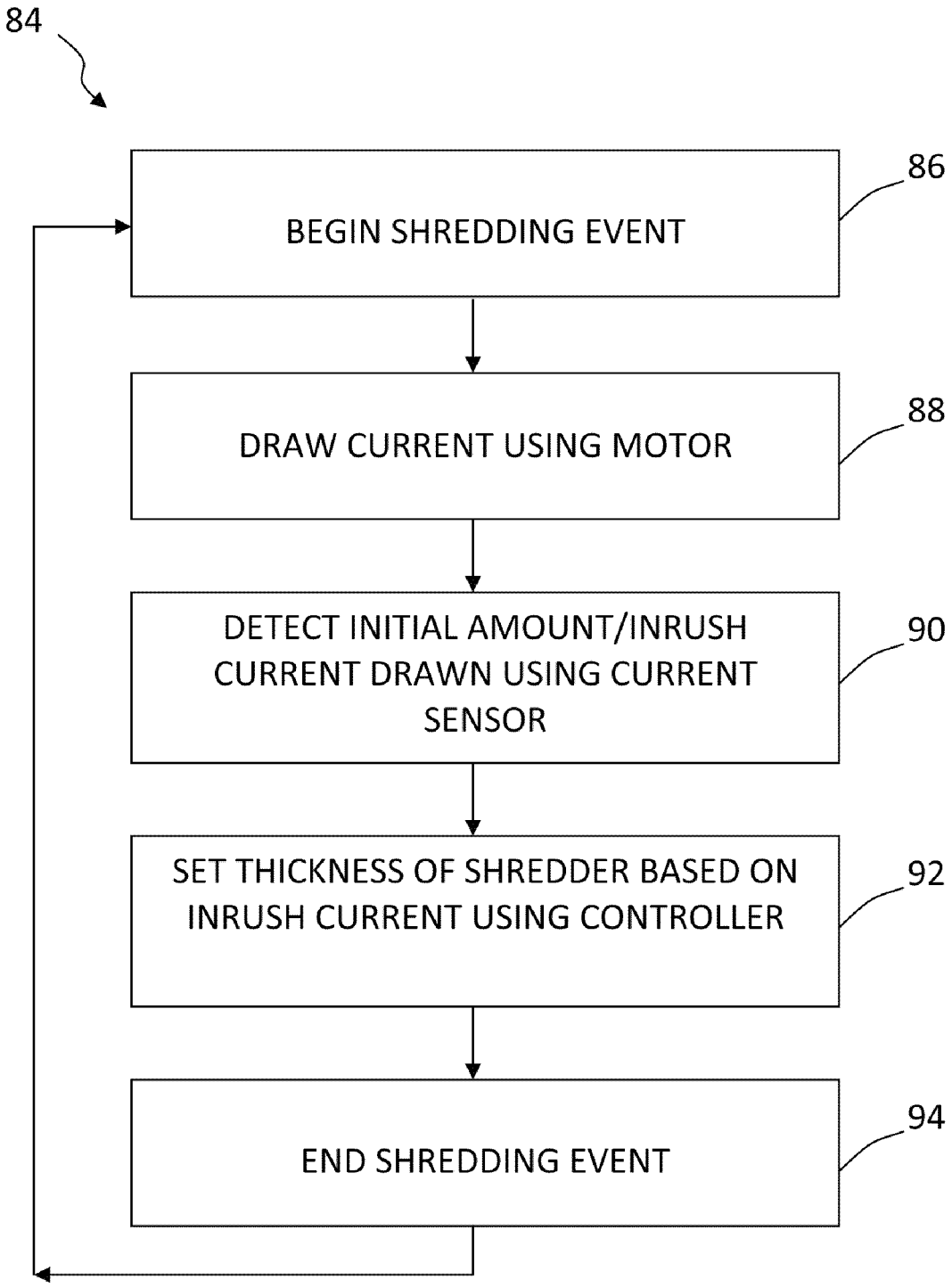
FIG. 8 is a flow diagram of a method for setting a thickness of an article that may be accepted by the shredder.

In addition to or as an alternative to setting the overload detection threshold, in an embodiment, the parameter set by the controller 42 may be a maximum thickness threshold for shredding articles with the shredder mechanism 20. The controller 42 is configured to adjust the maximum thickness threshold based on the detected initial (inrush) current for each shredding event, i.e., instantaneously in real time. The maximum thickness threshold can be altered (e.g., reduced) to reflect any loss in shredder capability over time and/or to compensate for the performance of the shredder 10. Based on the drift of the peak inrush (as shown by arrow 56 in FIG. 5), the parameter at which a detector determines that an article is too thick be automatically adjusted. FIG. 8 is a flow diagram of a method 84 for setting a thickness of an article that may be accepted by the shredder 10. The method 84 of FIG. 8 begins with a shredding event at 86, i.e., the motor 34 is supplied with power via the power source in order to rotate the shredder mechanism 20. The motor draws current at 88. At 90, the inrush current drawn or supplied to the motor for each shredding event is determined or detected using the current sensor 46. Then, at 92, the controller 42 sets the maximum thickness threshold of the shredder based on the determined inrush current at 90 (if needed). The shredding event ends as shown at 94, and the process repeats for each shredding event.

The graph in FIG. 5 shows a number of spikes labeled as 74 that occur during the period of time of the shredding events. These spikes 74 indicate that additional current is being supplied or drawn by the motor 34. Such spikes 74 may occur due to an increase in an article's thickness during shredding, such due to paper folds or creases that may occur during feeding, or due to one or more additional articles/pages being added to the throat as the article is pulled into the cutter elements 21 during shredding. When thicker articles are inserted into the throat 14, or when additional articles are added to the throat 14 that increase the thickness, the shredder mechanism 20 becomes more susceptible to jams. Moreover, if a jam does occur, and the motor 34 can not reverse its direction, the motor is likely to stall due to any one or more of reaching peak forward torque, peak current limit, peak temperature, etc.

Determining or tracking the time between successive shredding events can allow for adjustment of the thickness settings (e.g., if multiple successive passes have occurred). In another embodiment, adjustment(s) of the thickness setting are made directly according to variations in the inrush current (e.g., based on percentage changes from an initial reading (stored in memory) to a second reading).

FIG. 7 is a 2-D graph illustrating relationships between current, shredding events, thickness of articles, and time for an exemplary shredder. Using this shredder, a first run A of shredding events were performed at 110 volts and at a frequency of 50 Hz and a second run B of shredding events were performed at 90 volts and at a frequency of 60 Hz using an AC induction motor. As previously noted, some markets runs machines using both frequencies. However, it is to be understood that the same effects described below would apply to a steady voltage and frequency rate.

In first run A, when power is turned on at 100, there is an initial inrush current 102 of approximately 6 Amps and current is briefly drawn at approximately 4.5 Amps before stopping. A first shredding event 104 is run, indicating the same approximate initial inrush current of 6 Amps. The first shredding event 104 was performed using a single (1) sheet of paper for shredding by the shredder mechanism. As shown, during shredding, the current and power (here measured in Watts) remain substantially steady (the current remains substantially close to 4.5 Amps) during the shredding of the single sheet of paper, before dropping off at the end of the shredding event.

A second shredding event 106 is run using ten (10) sheets of paper. The initial inrush current is higher (i.e., approximately 6.5 Amps) for this shredding event 106. During the period of the shredding event, the current drawn by the motor sags or drops below 4.0 Amps. This is a result of poor power factor and the motor being run at an unsatisfactory or abnormal voltage/frequency (i.e., 110V, 50 Hz). While the current decreases, the power slightly increases. Then, just before the end of the shredding event, the current again increases to approximately 4.5 Amps before dropping to zero.

The third shredding event 108 is run using twelve (12) sheets of paper. Here the initial inrush current is approximately 6.0 Amps. Like the previous shredding event, during the period of the shredding event, the current drawn by the motor sags or drops (again, below 4.0 Amps), and the power further increases. In the illustrated embodiment, the current then again increases to approximately 4.5 Amps after shredding due to run-on (i.e., a no load operation of the motor for a time period (e.g., approximately 2 seconds) to clean the cutter elements). Thereafter, once the motor is stopped or turned off, the current and power may be dropped to zero.

Such a load (12 sheets or more) may cause potential overload of the motor. A spike of current caused at stall is shown generally at 109 as a high-current peak that lasts approximately 1 second. Also shown in an inrush spike. In this illustration, it can generally be seen that the inrush spike is relatively larger but shorter in duration as compared to the stall spike.

In second run B, the current drawn by the motor and power used is much lower at this voltage and frequency. When power is turned on at 110, there is an initial inrush current 112 of approximately 5 Amps and current is briefly drawn at approximately 1.25 Amps before stopping. A first shredding event 114 is run, indicating the same approximate initial inrush current of 5 Amps. The first shredding event 114 was performed using a single (1) sheet of paper for shredding by the shredder mechanism. As shown, during shredding, the current and power (here measured in Watts) remain substantially steady (the current remains substantially close to 1.25 Amps) during the shredding of the single sheet of paper, before dropping off at the end of the shredding event.

A second shredding event 116 is run using ten (10) sheets of paper. The initial inrush current is slightly higher (i.e., approximately 5.25 Amps) for this shredding event 116. During the period of the shredding event, the current drawn by the motor increases from approximately 1.25 Amps to numerous current spikes between 2.0 and 3.5 Amps. This is a result of the load on the motor. Thereafter, the current and power may be dropped to zero.

Such a load (10 sheets or more) at this frequency and power may cause potential overload of the motor. A spike of current caused at stall is shown generally at 118 as a high-current peak that lasts approximately 1 second. Also shown in an inrush spike. The inrush and stall spikes in this run are relatively close because paper was already in the throat when the machine was turned on during testing, so the machine went right from in-rush to stall.

Such a load (10 sheets or more) may cause potential overload of the motor. A spike of current caused at stall is shown generally at 109 as a high-current peak that lasts approximately 1 second. Also shown in an inrush spike (which is relatively larger but shorter in duration as compared to the stall spike). In this illustration, it can generally be seen that the stall spike at is slightly greater than the inrush spike of current.

It is noted that in the particular example shown in FIG. 7, the power factor of the tested motor was less when run at 50 Hz as compared to the 60 Hz function of the same motor (which may be likely due to flux saturation in the windings, for example). For this reason, the 50 Hz signals sag from no-load while shredding, while at 60 Hz, the current increases during shredding. Other motors may produce alternate results for current load during shredding; however, the inrush current and stalling concepts will be similar.

As shown in each of the runs A and B, an increase in thickness of the article (the paper itself or the number of sheets) can affect the motor drawn current during a shredding event. Thus, setting or adjusting a maximum thickness threshold in real time relative to the motor's characteristics (e.g., peak torque) can prevent possible motor stalls.

Figure 9:
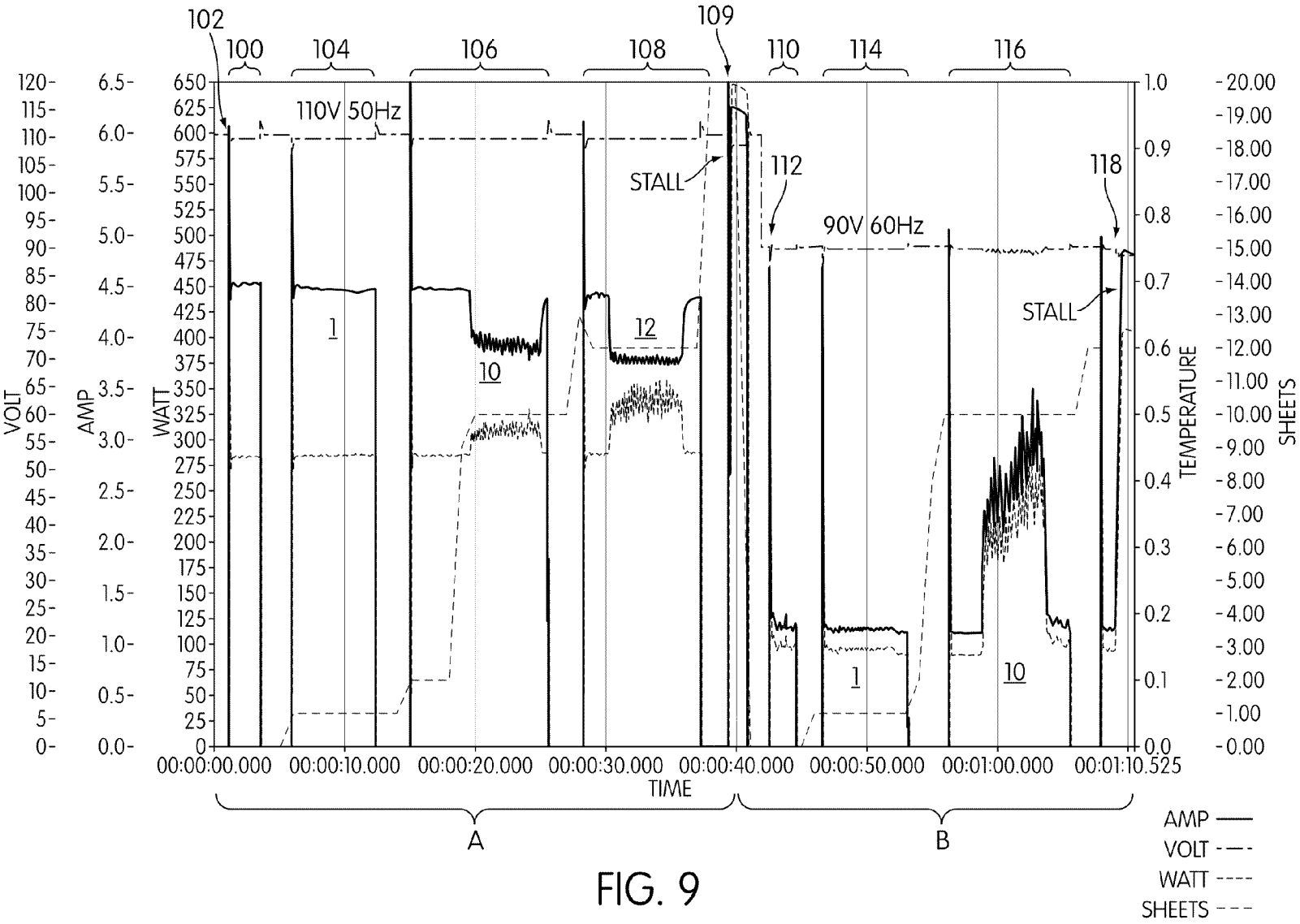
FIG. 9 is a 2-D graph illustrating relationships between current, shredding events, thickness, and time in accordance with an embodiment of the invention.

For example, using both runs A and B of FIG. 9 as an exemplary guide, the measured peak inrush is virtually on the stall current. The measured inrush current in these cases may be approximately 90 to 95 percent (%) of the measured stall current (or vice versa). For a typical system, it is known to designate an 'x' amount of sheets to trigger current limit rather than allowing the system to go to full stall. For example, if a sheet thickness is approximately to be about 0.1 mm, the thickness capacity may be set to no greater than 1.0 mm, or 10 sheets. Depending on the desired sheet count considered acceptable for shredding, the percentage could be adjusted, i.e., the thickness parameter setting can be adjusted. For example, referring to FIG. 9, in an embodiment, it may be desirable to trigger the system as being at capacity at a nominal voltage/frequency, e.g., approximately 75-50% of the inrush current. By adjusting this percentage paramter, the amount of load to the system before triggering a current limit can be detected.

It is noted that the percentage or parameter may vary based on different cutting blocks (different sized motors, gearing, etc.) and a desired trigger point(s). Therefore, in embodiments, the parameters set by the controller may be defined on a per-project or per-machine basis.

Thus, because the thickness threshold or capacity may be adjusted, it is to be understood that in an embodiment, one or more detectors 44 may also be provided in the shredder, as shown in FIG. 3. Detector(s) 44 are coupled to the controller 42. In an embodiment, a detector 44 may be provided to detect at least one article received in the throat. In an embodiment, a detector 44 may be a thickness detector configured to detect a thickness of the at least one article. For example, the thickness detector 44 may be provided in or adjacent the throat 14 of the shredder. The assignee of this application, Fellowes, Inc., has developed thickness sensing technologies for shredders. By sensing thickness of paper or articles being fed into the shredder, the shredder can be stopped (or not started) before a severe jam occurs. U.S. Pat. Nos. 7,631,822, 7,631,824, 7,635,102, and 7,631,823 and U.S. Patent Application Publication Nos. 2006/0054725 A1, 2009/0090797 A1, and 2007/0221767 A1 disclose, among other things, a detector that can determine if an overly thick object is being inserted in a shredder throat. See also, U.S. patent application Ser. Nos. 12/616,567 (U.S. Patent Application Publication No. 2010/0051731 A1), 12/579,905, 12/578,292 (U.S. Patent Application Publication No. 2010/0084496 A1), 12/409,896, 12/466,775, 12/487,220, 12/348,420 and 11/770,223 (U.S. Patent Application Publication No. 2007/0246586 A1) also owned by Fellowes, Inc. as detectors that may be used. Other examples of known shredders with thickness sensing features designed to prevent the cutter elements from jamming are U.S. Patent Application Publication Nos. 2009/0025239 A1, 2007/0246582 A2, and 2009/0032629 A1. U.S. patent application Ser. No. 12/790,517, filed May 28, 2010, is also an example of a thickness sensor that may be used with shredder 10 and may be set in real-time based on the detected inrush current. Each of the references provided herein are incorporated by reference in their entirety and are not meant to be limiting.

As is described in the above references, if a detector 44 determines that the thickness of an article in the throat 14 is substantially equal to or great than the maximum thickness threshold (e.g., there are too many sheets or pages), the controller 42 is used to stop or prevent the motor 34 from driving the cutter elements 21 in the shredding direction. Likewise, the controller 42 can stop the current flow to the motor 34.

In an embodiment, the thickness of the shredder may not need to be set (or reset) for each consecutive shredding event. For example, the thickness may remain at its current setting based on the detected inrush current of two consecutive shredding events. Logic or other algorithms may be used with the shredder 10 to make such determinations.

Figure 10:
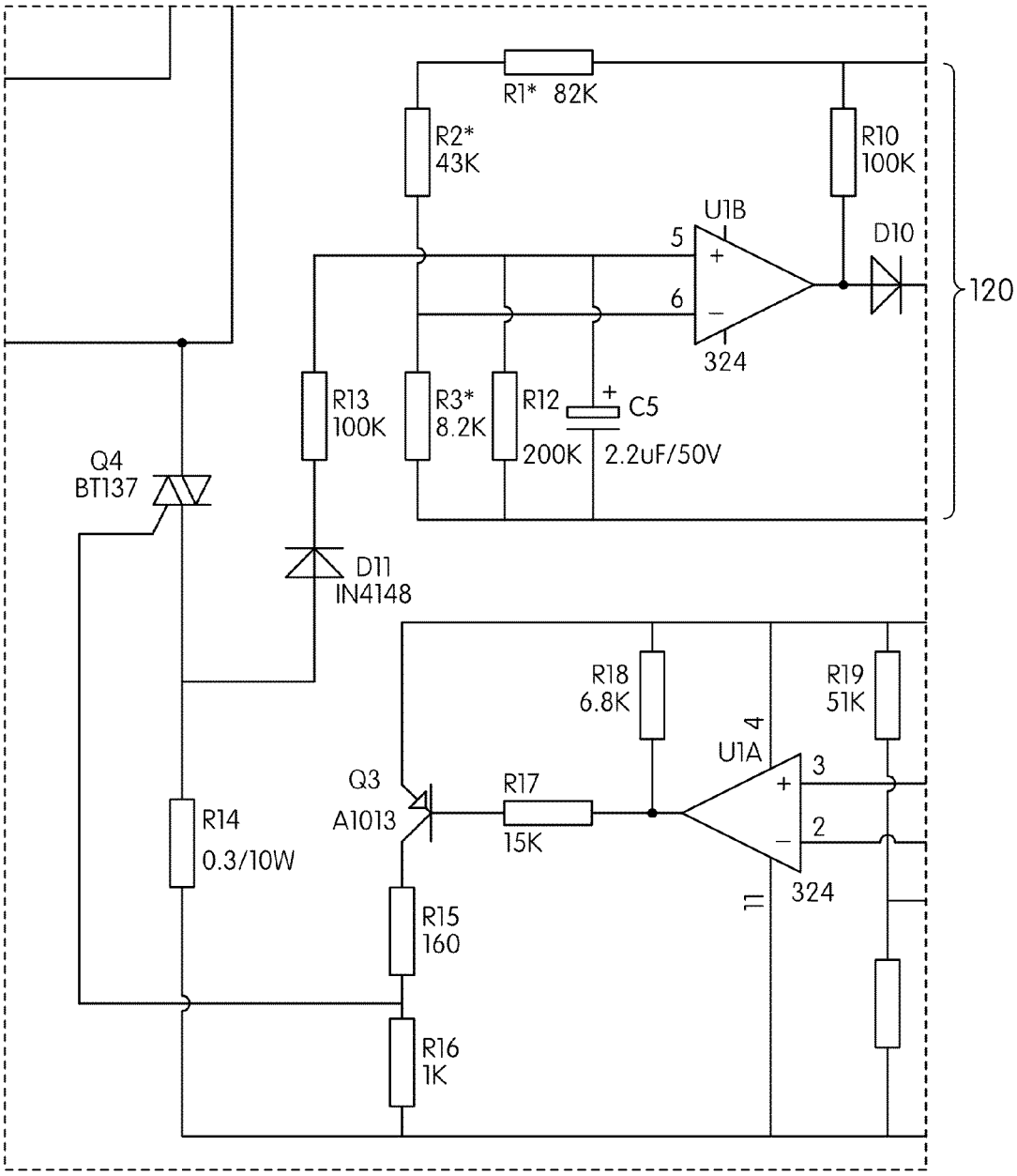
FIGS. 10 and 11 are exemplary schematic motor current detection circuit diagrams which may be used in accordance with an embodiment of the invention.
Figure 11:
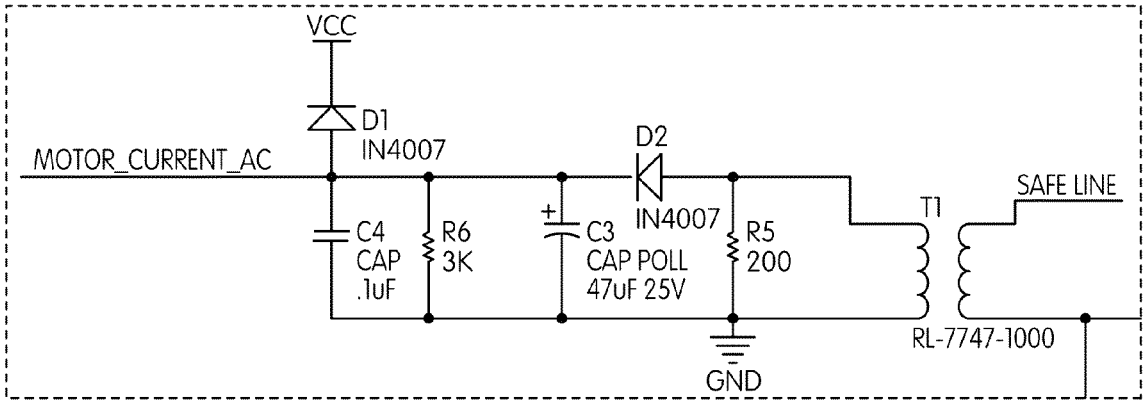

FIGS. 10 and 11 are exemplary schematic motor current detection circuit diagrams which may be used in accordance with an embodiment of the invention. The circuit diagram of FIG. 10 shows the use of a current sensor in the form of a resistor R14 and an op-amp circuit to monitor the current. As the current passes through the TRIAC Q3 and thus resister R14, a voltage is generated. The diode half-wave D11 rectifies the voltage to make it a DC output voltage (which is readable by processors or CPUs, such as those in controller 42). Then a conditioning circuit 120 is used to filter and amplify the circuit.

The circuit diagram of FIG. 11 shows the use of a current sense transformer T1. The current passes through transformer T1 through the primary windings (on the right side) and a burden resistor R5 turns the current through the secondary windings (on the left side) of the transformer into a voltage. The diode D2 is used to half-wave rectify the signal to give a DC output. The resistor and capacitor networks are used to smooth the signal to eliminate AC content. For example, if 25 Amps is passed through the primary windings, then with a 1000:1 turn ratio, the secondary windings would give 0.025 Amps at the output. When that current passes through a 200 ohm resistor, 5 volts would be achieved. The processor (or controller or computer) would see that voltage, less the diode drop, and less the filtering loss from the RC network (dependant upon line frequency).

Of course it is to be understood that, in correlation with the thickness detector 44, in some embodiments, the shredder 10 may further comprise an alarm indicator system, and the predetermined operation (e.g., performed by the controller 42) is alerting the user via the alarm indicator system. For example, in an embodiment, upon detecting that the article(s) inserted into the throat 14 exceed the predetermined maximum thickness threshold, the controller 42 may communicate with an indicator such as indicator 37 or 39 (shown in FIG. 1) to provide a warning or alarm signal to the user. This signal may be an audible signal in which the controller 42 sounds an audible alarm and/or a visual signal, wherein the controller 42 may illuminate a visual indicator. Examples of audible signals include, but are not limited to, beeping, buzzing, and/or any other type of signal that will alert the user via sound(s) that the article or document that is about to be shredded is above a predetermined maximum thickness threshold, and may cause the shredder mechanism 20 of the shredder 10 to jam. This gives the user the opportunity to reduce the thickness of the article, or to reconsider forcing the article into the throat 14 and through the shredder, knowing that any such forcing may jam and/or damage the shredder.

In an embodiment, a visual signal, indicating that an article such as article 122 is too thick, may be provided in the form of a red warning light, which may be emitted from an LED, using indicator 37, for example. It is also contemplated that a green light may also be provided to indicate that the shredder 10 is ready to operate. In an embodiment, an indicator 37 may be used which is a progressive indication system that includes a series of indicators in the form of lights to indicate the thickness of the stack of documents or other article relative to the capacity of the shredder is provided. For example, the progressive indication system may include one or more green lights, a plurality of yellow lights, and one or more red light. The green light(s) indicate that the detected thickness of the item (e.g. a single paper, a stack of papers, a compact disc, a credit card, etc.) that has been placed in the throat 14 of the shredder 10 is below a predetermined thickness and well within the capacity of the shredder. The yellow lights provide a progressive indication of the thickness of the item. In an embodiment, a first yellow light, located next to the green light, would be triggered when the detected thickness is at or above a first predetermined thickness, but below a second predetermined thickness that triggers the red light(s). If there is more than one yellow light, each additional yellow light may correspond to thicknesses at or above a corresponding number of predetermined thicknesses between the first and second predetermined thicknesses. The yellow lights may be used to train the user into getting a feel for how many documents should be shredded at one time. The red light(s) indicate that the detected thickness is at or above the second predetermined thickness, which may be the same as the predetermined maximum thickness threshold, thereby warning the user that this thickness has been reached. U.S. Application Publication No. 20090090797 A1, Ser. No. 11/867,260, filed on Oct. 4, 2007 and assigned to the same assignee (Fellowes, Inc.), illustrates and describes such a progressive system, and is hereby incorporated by reference in its entirety.

Similarly, the aforementioned indicators of the progressive indicator system may be in the form of audible signals, rather than visual signals or lights. For example, like the yellow lights described above, audible signals may be used to provide a progressive indication of the thickness of the item. Also, in an embodiment, the visual and audible signals may be used together in a single device. Also, other ways of indicating progressive thicknesses of the items inserted in the throat 14 may be used, and the illustrations and descriptions of indicator 37 should not be limiting.

Other embodiments include incorporating the above method into a computer program product or a set of computer executable instructions readable by a computer and stored on a data carrier or otherwise a computer readable medium, such that the method 61 is automated. In a possible embodiment, the method may be incorporated into an operative set of processor executable instructions configured for execution by at least one processor or a controller or computer. The instructions may be incorporated or added to an existing shredder. In an embodiment, it is envisioned that the controller 42 may comprise program code of machine or processor executable instructions in a memory that, when executed, instructs the controller 42 to perform the method of monitoring the shredder, to operate the shredder 10, detect at least an inrush current and/or set a parameter of the shredder 10. The controller 42 processes the instructions and subsequently applies them by detecting the inrush current and setting the parameter. FIG. 6 shows a flow chart of such computer readable instructions.

For example, in an embodiment, when the executable instructions are executed by a computer or processor, they cause a computer or processor to automatically perform a method for monitoring operation of the shredder. In alternative embodiments, hard-wired circuitry may be used in place of or in combination with software instructions to implement the disclosure. Thus, embodiments of this disclosure are not limited to any specific combination of hardware circuitry and software. Any type of computer program product or medium may be used for providing instructions, storing data, message packets, or other machine readable information associated with the method 61. The computer readable product or medium, for example, may include non-volatile memory and other permanent storage devices that are useful, for example, for transporting information, such as data and computer instructions. In any case, the medium or product should not be limiting.

All patents and applications mentioned herein, including those in the Related Art section, are hereby incorporated herein by reference in their entirety.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a housing having a throat for receiving at least one article to be shredded;

a shredder mechanism received in the housing and including an electrically powered motor and cutter elements, the shredder mechanism enabling the at least one article to be shredded to be fed into cutter elements and the motor being operable to drive the cutter elements in a shredding direction so that the cutter elements shred the articles fed therein upon receiving electrical power via a power source;

a current sensor for detecting current flowing through the motor;

a controller coupled to the motor for controlling operation of the motor;

the controller also being coupled to the current sensor and configured to detect at least an inrush current supplied to the motor for each shredding event of a plurality of shredding events, and the controller being configured to set a parameter of the shredder based on the detected inrush current supplied to the motor.

2. A shredder according to claim 1, wherein the controller is configured to set an overload detection threshold at or before which the motor will stall, and wherein, upon detection by the controller that a load on the motor is substantially equal to or greater than the overload detection threshold, the controller is configured to limit the electrical power to the motor, thereby preventing the motor from driving the cutter elements in the shredding direction.

3. The shredder according to claim 2, wherein the controller is configured to adjust the overload detection threshold based on the detected inrush current for each shredding event.

4. A shredder according to claim 2, wherein the threshold is set based on a fraction of the detected inrush current.

5. A shredder according to claim 1, wherein the controller is configured to set a maximum thickness threshold for shredding articles with the shredder mechanism, and wherein, upon detection by the controller that the at least one article received by the throat is substantially equal to or greater than the maximum thickness threshold, the controller is configured to limit the electrical power to the motor, thereby preventing the motor from driving the cutter elements in the shredding direction.

6. The shredder according to claim 5, wherein the controller is configured to adjust the maximum thickness threshold based on the detected inrush current for each shredding event.

7. The shredder according to claim 1, further comprising a detector for detecting the at least one article received in the throat, the detector being coupled to the controller.

8. The shredder according to claim 7, wherein the detector is a thickness detector configured to detect a thickness of the at least one article, and, wherein the controller is coupled to the thickness detector and the parameter is a maximum thickness threshold.

9. The shredder according to claim 8, wherein the controller is configured to prevent the motor from driving the cutter elements in the shredding direction based on the at least one article received by the throat being substantially equal to or greater than the maximum thickness threshold.

10. The shredder according to claim 9, wherein the controller is configured to adjust the maximum thickness threshold based on the detected inrush current for each shredding event.

11. The shredder according to claim 1, wherein the current sensor is integrated within the controller.

12. The shredder according to claim 1, wherein the current sensor is separate from the controller.

13. The shredder according to claim 1, wherein the motor is selected from the group consisting of: an AC induction motor, a DC motor, a permanent magnet motor, or a universal motor.

14. A method for monitoring operation of a shredder, the shredder comprising a housing having a throat for receiving at least one article to be shredded, a shredder mechanism received in the housing and including an electrically powered motor and cutter elements, the shredder mechanism enabling the at least one article to be shredded to be fed into cutter elements and the motor being operable to drive the cutter elements in a shredding direction so that the cutter elements shred the articles fed therein upon receiving power via a power source, a current sensor for detecting current flowing through the motor, and a controller coupled to the current sensor and coupled to the motor for controlling operation of the motor; the method comprising:

powering the motor with electrical power via the power source;

detecting with the controller an inrush current supplied to the motor for each shredding event of a plurality of shredding events, and setting with the controller a parameter of the shredder based on the determined inrush current supplied to the motor.

15. The method according to claim 14, wherein the controller sets an overload detection threshold at which the motor will stall, and further comprising:

limiting via the controller the electrical power to the motor to prevent the motor from driving the cutter elements in the shredding direction upon a load on the motor is substantially equal to or greater than the overload detection threshold.

16. The method according to claim 15, further comprising adjusting via the controller the overload detection threshold based on the detected inrush current for each shredding event.

17. The method according to claim 14, wherein the controller sets a maximum thickness threshold for shredding articles with the shredder mechanism, and further comprising:

limiting via the controller the electrical power to the motor to prevent the motor from driving the cutter elements in the shredding direction upon detection by the controller that the at least one article received by the throat is substantially equal to or greater than the maximum thickness threshold.

18. The method according to claim 17, further comprising adjusting via the controller the maximum thickness threshold based on the detected inrush current for each shredding event.

19. The method according to claim 14, further comprising detecting with a detector the at least one article received in the throat, the detector being coupled to the controller.

20. The method according to claim 19, wherein the detector is a thickness detector, wherein the controller is coupled to the thickness detector and the parameter is a maximum thickness threshold, and further comprising:

detecting a thickness of the at least one article received by the throat.

21. The method according to claim 20, wherein the controller is configured to prevent the motor from driving the cutter elements in the shredding direction based on the at least one article received by the throat being substantially equal to or greater than the maximum thickness threshold.

22. The method according to claim 21, further comprising adjusting via the controller the maximum thickness threshold based on the detected inrush current for each shredding event.

* * * * *